US005299535A

United States Patent [19]

Payne

[11] Patent Number: 5,299,535

[45] Date of Patent: Apr. 5, 1994

[54] FURNACE BUCKSTAY STIRRUP

[75] Inventor: Ronald G. Payne, West Simsbury, Conn.

[73] Assignee: Combustion Engineering, Inc., Windsor, Conn.

[21] Appl. No.: 998,170

[22] Filed: Dec. 29, 1992

[51] Int. Cl.[5] ..... F22B 37/24

[52] U.S. Cl. ..... 122/510; 122/6 A

[58] Field of Search ..... 122/510, 511, 6 A; 165/67

[56] References Cited

U.S. PATENT DOCUMENTS 3,861,360 1/1975 Shank, Jr. ..... 122/6 A 4,499,860 2/1985 Loomis et al. ..... 122/510

*Primary Examiner*—Edward G. Favors

*Attorney, Agent, or Firm*—Robert S. Smith

[57] ABSTRACT

A vapor generation apparatus which includes a furnace, having a tube wall and at least one vertical buckstay member disposed proximate to the outer face of the spiral tube wall. The apparatus includes a stirrup for transmitting forces between the spiral tube wall and the vertical buckstay member. The stirrup includes a U-shaped plate and a cylindrical member, apparatus for mounting the cylindrical member on the vertical buckstay member including first and second lugs fixed to the vertical buckstay member in spaced relationship. The cylindrical member is fixed between the first and second lugs in spaced relation to the vertical buckstay member. The apparatus also includes apparatus for mounting the U-shaped plate on the tube wall.

17 Claims, 4 Drawing Sheets

FURNACE BUCKSTAY STIRRUP

BACKGROUND OF THE INVENTION

The invention relates to vapor generation apparatus and particularly to apparatus for connecting the buckstay structure to the tube wall. While the invention has particular application to spiral tube wall furnace constructions it will be understood that it also has application to vertical tube furnace apparatus.

Vapor generation apparatus such as large utility boilers that are disposed in a frame that is provided to withstand the internal furnace gas pressure. As the furnace approaches operating temperature, the furnace walls expand vertically and horizontally. Additionally, the pressure excursions within the furnace, either an increase or a decrease in pressure within the furnace, cause a resultant additional flexing of the tube walls either inwardly or outwardly in a horizontal direction.

It is customary in the art to locate buckstays in the form of I-beams adjacent opposite walls of the furnace so that the buckstays can be attached to the furnace wall to maintain the adjacent wall in a flat condition. Typically both vertical and horizontal structural members are used that are respectively known as vertical and horizontal buckstays.

Since the furnace walls change in temperature from ambient to temperatures in the order of 400 degrees Centigrade, while the buckstays are at ambient temperature essentially at all times, it is essential that provision be made to permit appropriate expansion. This is accomplished by carrying the buckstays on the wall in a manner which permits the vertical expansion of the walls. The opposing buckstays are tied to each other through connections which are at the boiler wall temperature.

Typically, the horizontal buckstays are disposed in bands around the perimeter of the furnace tube walls at vertically spaced intervals (often between 15 and 40 feet) throughout the height of the furnace wall. Horizontally, the buckstays on opposite walls of the furnace are interconnected through buckstay ties so that the reaction of one buckstay is resisted by the reactions of the buckstay on the opposing wall so it can counteract the pressure forces acting on the furnace walls. It has been customary to provide vertical support members to interconnect adjacent buckstays with a connection that permits a sliding action that permits relative movement between the furnace tube wall with which a buckstay cooperates and the buckstays themselves. As the furnace expands in a vertical direction the effect on the various levels of buckstays will be different.

Because of the temperature differential between the furnace wall and the buckstays it is preferred to locate the buckstays a short distance from the furnace wall with insulation therebetween. Apparatus referred to as stirrups are used to make this connection between the furnace wall and the buckstay. The stirrup is a device known in the art which allows gas pressure loading to be transmitted from the furnace tube walls to the buckstay system while allowing unrestricted thermal expansion of the boiler tube wall envelope. Known stirrup constructions are disclosed in U.S. Pat. No. 4,395,860, and 4,059,075. These stirrups may be connected to the furnace wall and operate to support the buckstay as well as to prevent relative inward or outward movement between the buckstay and the wall.

The prior art designs are not wholly satisfactory because they will not transmit loading due to negative furnace gas pressure loading. In addition, the conventional design must be attached to a flat surface. Still another disadvantage of most designs is that there is insufficient contact area for connection to the buckstay for bearing requirements. Still another disadvantage of the present design is that it attaches to the boiler support plates and this causes an undesirable additional loading on the boiler support plates.

The principle of the spiral wall helical wall furnace is to increase the mass flow per tube by reducing the number of tubes needed to envelope the furnace without increasing the spacing between the tubes. This is done by arranging the tubes at an angle and spiralling them around the furnace.

It is customary in spiral tube wall furnaces to provide the spiral tube construction in only the lower elevational portion of the furnace. The walls are of plate and tube construction meaning that the a plurality of spirals of tubes are substantially coplanar and adjacent axial sections are joined by an intermediate fin. Typically the spiral tube is disposed at angle with respect to a horizontal plane and the angle is typically between 7 and 30 degrees. Without additional structure to support the tubing, the entire weight of the wall would be supported by welds intermediate the respective fins and tubes.

To avoid placing the weight on the welds between respective fins and axial sections of tubing it is customary to provide support plates that span a plurality of tubes to avoid the loading on the fins and tubes that may even flatten the normally round tubes.

It is desirable to connect the tube walls to the buckstays with stirrups. The stirrup allows relative motion between the tube wall the buckstay system.

SUMMARY OF THE INVENTION

It is an object of the invention to provide apparatus that does not restrict movement in response to thermal expansion of the boiler tube walls.

It is another object of the invention to provide a smooth sliding surface between the buckstay member and the stirrup.

Another object of the invention is to provide apparatus which will attach to the tube wall without the necessity of attaching to a flat surface such as the spiral tube wall support plates or local weld attachments.

Yet another object of the invention is to provide apparatus which is capable of transmitting furnace gas pressure loading from the boiler walls to the buckstay system in both positive and negative directions.

Still another object of the invention is to provide a simplified method of field assembly which compensates for fit resulting from tolerance build-up and which is first noticed during field assembly.

Yet another object of the invention is to provide a stirrup construction that will provide proper engagement with essentially any part of the tube wall and thus is not limited to only specific locations.

It has now been found that these and other objects of the invention may be attained in a vapor generation apparatus which includes a furnace, having a tube wall and at least one vertical buckstay member disposed proximate to the outer face of the spiral tube wall. The apparatus includes a stirrup for transmitting forces between the spiral tube wall and the vertical buckstay member. The stirrup includes a U-shaped plate and a cylindrical member, means for mounting the cylindrical member on the vertical buckstay member including first and second lugs fixed to the vertical buckstay member in spaced relationship. The cylindrical member is fixed between the first and second lugs in spaced relation to the vertical buckstay member. The apparatus also includes means for mounting the U-shaped plate on the tube wall.

In some forms of the invention the lugs are generally planar and disposed in generally parallel relationship. The U-shaped plate may include at least one generally planar face. The U-shaped plate includes a second and a third generally planar face in some forms of the invention. The second and third generally planar faces may be disposed in spaced opposed relationship. The first, second and third generally planar face may be substantially square.

In some forms of the invention the tube wall is a spiral tube wall and the means for mounting the U-shaped plate on the spiral tube wall includes a plurality of scalloped mounting tabs dimensioned and configured for engaging the spiral tube wall. The scalloped mounting tabs may have two arcuate portions dimensioned and configured for engaging adjacent tubes in the spiral tube wall.

BRIEF DESCRIPTION OF THE DRAWINGS

The invention will be better understood by reference to the accompanying drawing in which.

DETAILED DESCRIPTION OF THE PREFERRED EMBODIMENT

Figure 1:
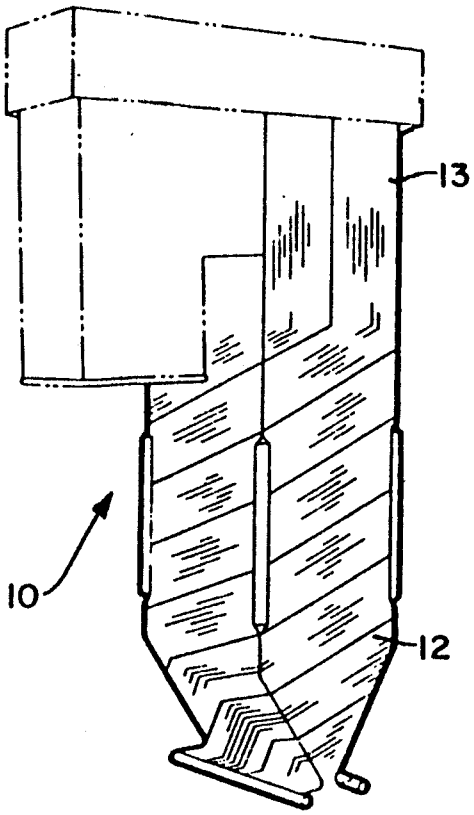
FIG. 1 is a simplified perspective view of a spiral tube wall furnace.

Referring now to FIG. 1 there is shown a furnace 10 that has a spiral tube wall 12 that comprises a plurality of axial sections of tube 14 coupled by respective fin 16. In the customary manner the upper portions have vertical tubes 13. The apparatus in accordance with the invention provides a connection between the boiler tube walls 12 and the buckstay system to resist furnace gas pressure loading.

Figure 6:
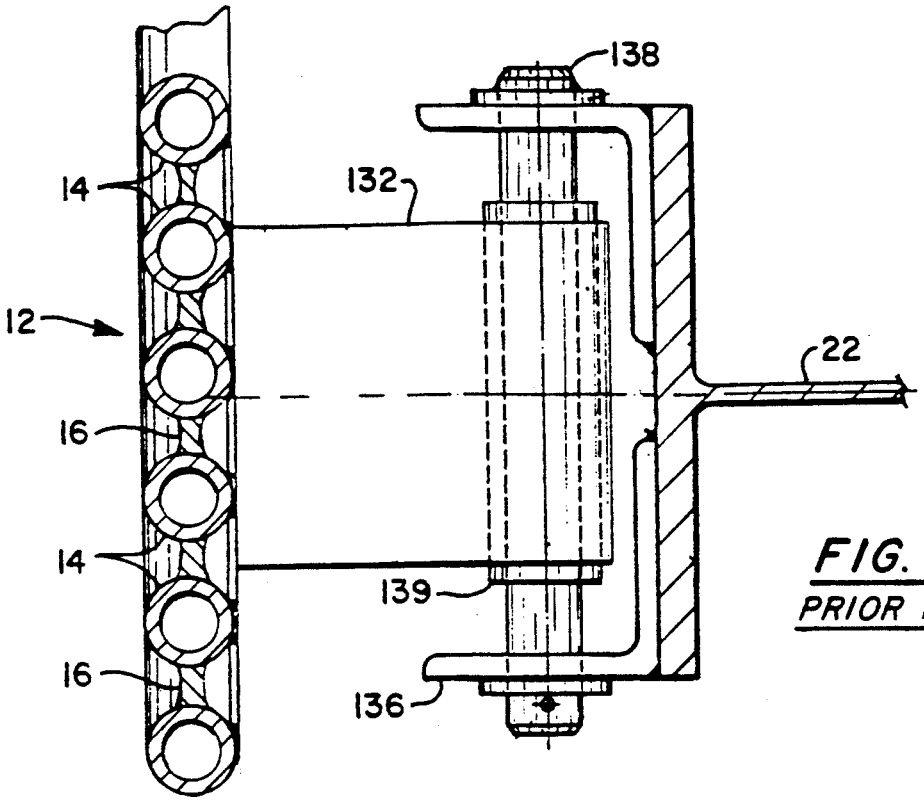
FIG. 6 PRIOR ART
FIG. 6 is a plan view of a prior art apparatus.
Figure 7:
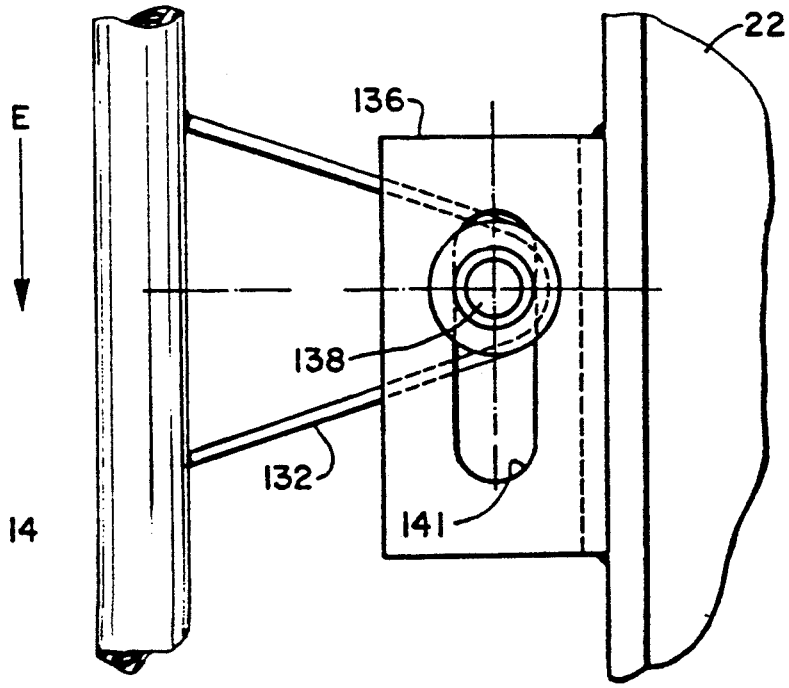
FIG. 7 PRIOR ART
FIG. 7 is a side view of the prior art apparatus of FIG. 6.

Referring now to FIGS. 6 and 7 there is shown a prior art stirrup that cooperates with a vertical buckstay member 22 and a spiral tube wall 12. The axial sections of tube 14 comprises a plurality of axial sections of tube 14 separated by respective fins 16. A V-shaped plate 132 is fixed to a plurality of plates that have the outer faces thereof disposed in tangential relationship respective axial sections of tube 14 in the spiral tube wall 12. It is this substantially flat surface that is necessary for this prior art structure. The V-shaped plate 132 also a sleeve 139 that is disposed around a headed pin 138. The headed pin 138 is carried in respective slots 141 in the opposed flanges of a channel shaped mount 136. One disadvantage of this structure is the contact area between the headed pin 138 and the slots 141. In some cases the flanges in which the slots 141 are disposed are about ⅜" thick and thus there is line contact with the headed pin 138 for one a very small axial part of the headed pin 138.

Figure 2:
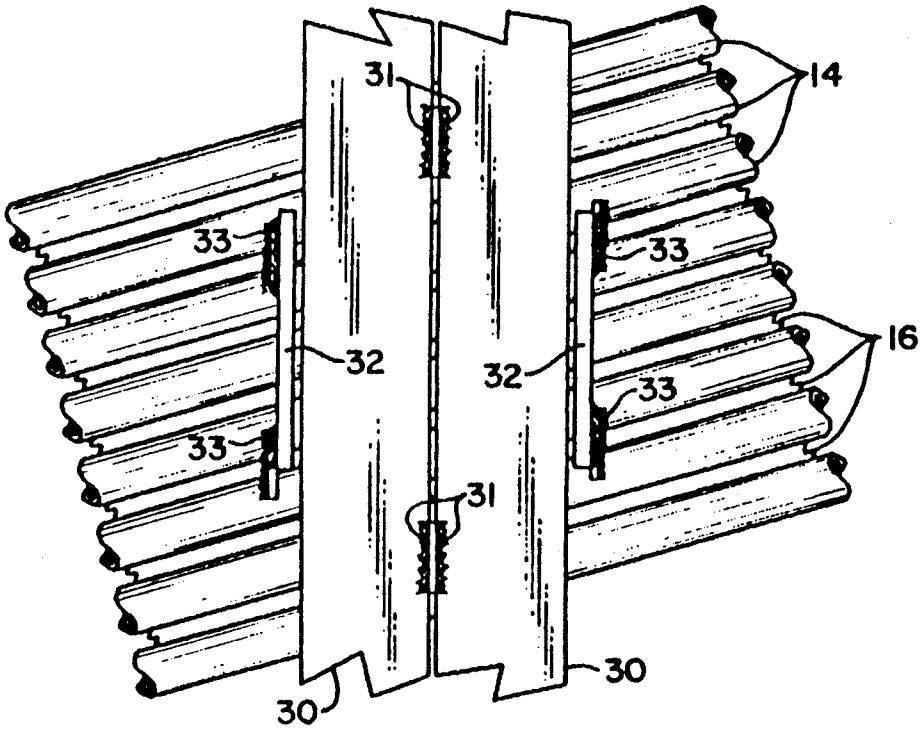
FIG. 2 is a fragmentary front elevational view of a section of spiral tube wall having support plates extending between the axial section of tubes.
Figure 4:
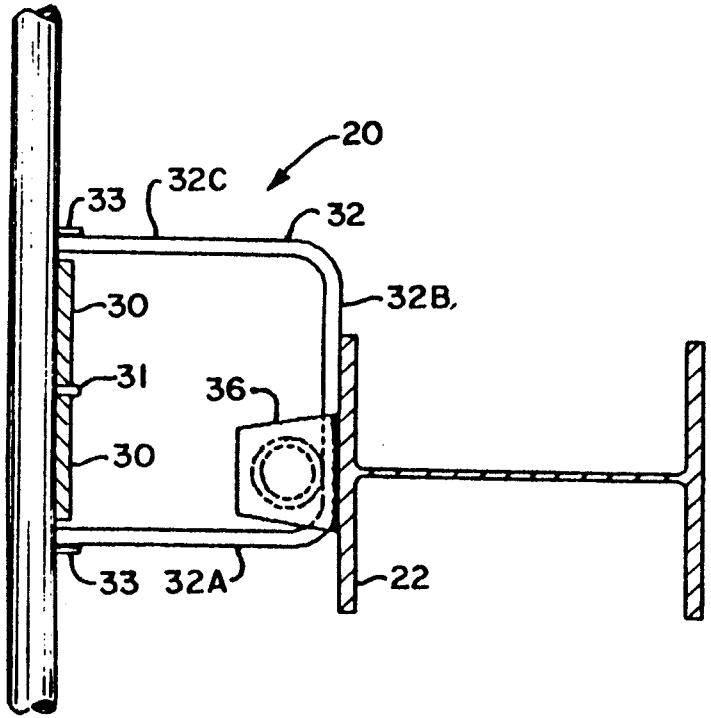
FIG. 4 is a plan view that shows the support tabs for the stirrups in accordance with one form of the invention and more particularly shows the cooperation with the vertical buckstay.
Figure 3:
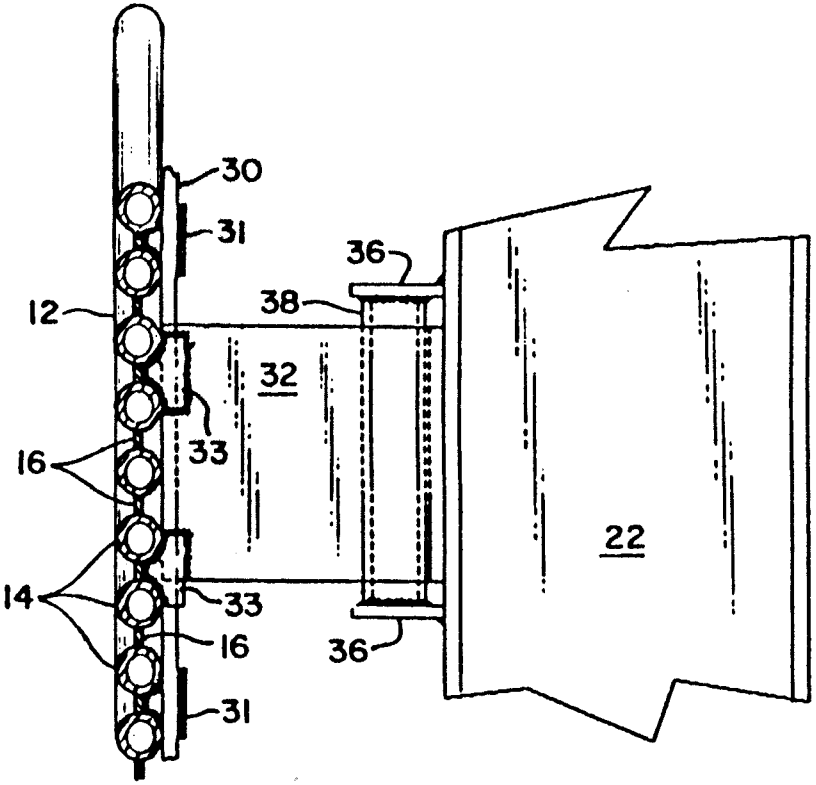
FIG. 3 is a side elevational view showing a broken away vertical buckstay and support tabs for support plates.

Referring now to FIGS. 2–4, the vertical buckstay member 22 is disposed at ambient temperature and thus will have no thermal expansion. A stirrup 20 is required to allow for the differential expansion of the tube wall 12 and the vertical buckstay member 22. Horizontal expansion, that is expansion along the horizontal direction in the plane of the spiral tube wall 12, is accommodated by the sliding of the U-shaped plate 32 on the face of the vertical buckstay member 22. As best seen in FIG. 3 the U-shaped plate 32 has three substantially square planar faces. In other words, each face has a width that is substantially the height thereof. The three faces include a center face 32B that abuts the vertical buckstay member 22. Two opposed side faces extend from the center face and are joined by the mounting tabs 33 to the spiral tube wall 12.

Both positive and negative furnace gas pressure loading, in the direction perpendicular to the plane of the spiral tube wall 12, is transmitted from the spiral tube wall 12 to the vertical buckstay member 22. A cylindrical member 38 is carried on the vertical buckstay member 22 by the combination with two lugs 36 that carry the cylindrical member 38 therebetween. The cylindrical member 38 and the two lugs 36 resist any the negative furnace gas pressure loading. More specifically, a U-shaped plate 32 engages the cylindrical member 38 and the spiral tube wall 12. The contact between the U-shaped plate 32 and the vertical buckstay member 22 resist the loading from the positive furnace gas pressure loading.

Advantageously, the U-shaped plate 32 is attached to the spiral tube wall 12 without loading the support plates 30 that are carried on the spiral tube wall 12. The support plates 30 are provided to support the spiral tube wall 12. In the absence of the support plate 30 the weight of the individual axial sections of tube 14 may be greater that the respective fins 16 can support. Although it may be easy to connect a stirrup to the support plate 30 it may be undesirable because the support plate 30 cannot sustain the additional loading.

Accordingly, the preferred embodiment of the invention includes a plurality of scalloped mounting tabs 33 connecting the U-shaped plate 32 to the spiral tube wall 12. In the preferred embodiment each mounting tab 33 has two arcuate faces dimensioned and configured for engaging two adjacent axial sections of tube 14 as best seen in FIG. 3.

The individual mounting tabs 33 are welded to the respective axial sections of tube 14 and also to the U-shaped plate 32. As will best be seen in FIGS. 3 and 4 two such mounting tabs 33 are disposed on the outboard sides of the U-shaped plate 32. The support plates 30 are mounted with a plurality of support plate mounting tabs 31 that are similar to the mounting tabs 33 and are welded to respective axial sections of tube 14 and one of the support plates support plate 30. In the preferred embodiment two mounting tabs 33 are provided to mount the two support plates 30.

The vertical expansion differential is accommodated by the cylindrical member 38 and the clearance provided between the U-shaped plate 32 and the two lugs 36 disposed at the axial extremities of the cylindrical member 38.

The apparatus in accordance with the invention allows for field adjustability with respect to the attachment to the tube wall 12 and the attachment to the vertical buckstay member 22. In addition, the invention provides for attachment to the tube wall 12 without the need for a flat surface such as support plate 30 and thus without loading the spiral tube wall support plates 30. Still another advantage is that the present invention resists loading in both positive and negative directions.

Figure 5:
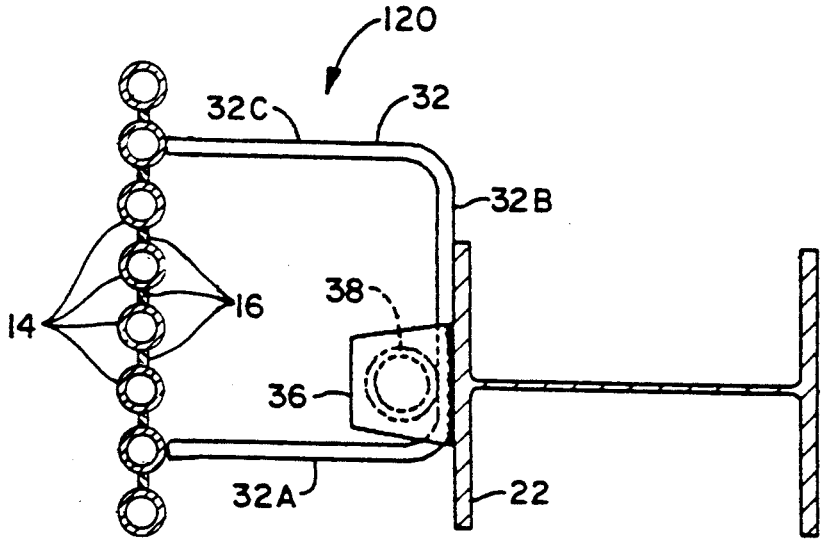
FIG. 5 is a plan view of a stirrup installation on a vertical tube wall section.

Referring now to FIG. 5 there is shown another embodiment of the invention that cooperate with a vertical tube wall 13. In the embodiment of the invention illustrated in FIG. 5, the U-shaped plate 32 is welded to with axial sections of tube 14 without the need for scalloped plates. It will be understood that the vertical tube wall 13 has vertical tubes in the embodiment of FIG. 5.

In the embodiment of FIGS. 2–4 the welding of the mounting tabs 33 to the lugs of the U-shaped plate 32 can be made within a range of elevations. This allows for dimensional discrepancies. More specifically, it provides for location of the stirrup 20 both in the vertical direction and the horizontal direction of the plane of the spiral tube wall 12.

The cylindrical member 38 and lugs 36 assembly can be located on the vertical buckstay member 22 so as to provide proper clearance for expansion regardless of where the U-shaped plate 32 is attached to the spiral tube wall 12. This is in contrast to the prior art design that requires the V-shaped plate 132 to be attached to a flat surface such a plate or series of plates welded between tubes to produce a flat surface. This requires an exact location of the stirrup attachment during fabrication. The improved design in accordance with the invention can be attached to any location of the tube wall because the scalloped plate mounting tab 33 can be placed between axial sections of tube 14 and still contact the U-shaped plate 32 in a location for sufficient welding.

The stirrup 20 can be located anywhere without having to be attached to the support plates 30. Thus here will no undesired component of loading on the support plate 30 due to furnace gas pressure.

The stirrup 20 is capable of transmitting both positive and negative loadings from the tube wall to the buckstay due to the welding of the mounting tabs 33 directly to the spiral tube wall 12.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the following claims.

Having thus described my invention I claim:

1. A vapor generation apparatus which comprises:

a furnace, having a tube wall and at least one vertical buckstay member disposed proximate to the outer face of said spiral tube wall;

a stirrup for transmitting forces between said spiral tube wall and said vertical buckstay member, said stirrup including a U-shaped plate and a cylindrical member, means for mounting said cylindrical member on said vertical buckstay member including first and second lugs fixed to said vertical buckstay member in spaced relationship, said cylindrical member being fixed between said first and second lugs in spaced relation to said vertical buckstay member; and means for mounting said U-shaped plate on said tube wall.

2. The apparatus as described in claim 1 wherein:

said lugs are generally planar and disposed in generally parallel relationship.

3. The apparatus as described in claim 2 wherein:

said U-shaped plate includes at least one generally planar face.

4. The apparatus as described in claim 3 wherein:

said U-shaped plate includes a second generally planar face.

5. The apparatus as described in claim 4 wherein:

said U-shaped plate includes a third generally planar face.

6. The apparatus as described in claim 5 wherein:

said second and third generally planar faces are disposed in spaced opposed relationship.

7. The apparatus as described in claim 6 further including:

said first generally planar face is substantially square.

8. The apparatus as described in claim 7 wherein:

said second and third generally planar faces are substantially square.

9. The apparatus as described in claim 1 wherein:

said tube wall is a spiral tube wall and said means for mounting said U-shaped plate on said spiral tube wall includes a plurality of scalloped mounting tabs dimensioned and configured for engaging said spiral tube wall.

10. The apparatus as described in claim 9 wherein:

said scalloped mounting tabs have two arcuate portions dimensioned and configured for engaging adjacent tubes in said spiral tube wall.

11. The apparatus as described in claim 2 wherein:

said tube wall is a spiral tube wall and said means for mounting said U-shaped plate on said spiral tube wall includes a plurality of scalloped mounting tabs dimensioned and configured for engaging said spiral tube wall, said scalloped mounting tabs have two arcuate portions dimensioned and configured for engaging adjacent tubes in said spiral tube wall.

12. The apparatus as described in claim 3 wherein:

said tube wall is a spiral tube wall and said means for mounting said U-shaped plate on said spiral tube wall includes a plurality of scalloped mounting tabs dimensioned and configured for engaging said spiral tube wall, said scalloped mounting tabs have two arcuate portions dimensioned and configured for engaging adjacent tubes in said spiral tube wall.

13. The apparatus as described in claim 4 wherein:

said tube wall is a spiral tube wall and said means for mounting said U-shaped plate on said spiral tube wall includes a plurality of scalloped mounting tabs dimensioned and configured for engaging said spiral tube wall, said scalloped mounting tabs have two arcuate portions dimensioned and configured for engaging adjacent tubes in said spiral tube wall.

14. The apparatus as described in claim 5 wherein:

said tube wall is a spiral tube wall and said means for mounting said U-shaped plate on said spiral tube wall includes a plurality of scalloped mounting tabs dimensioned and configured for engaging said spiral tube wall, said scalloped mounting tabs have two arcuate portions dimensioned and configured for engaging adjacent tubes in said spiral tube wall.

15. The apparatus as described in claim 6 wherein: said tube wall is a spiral tube wall and said means for mounting said U-shaped plate on said spiral tube wall includes a plurality of scalloped mounting tabs dimensioned and configured for engaging said spiral tube wall, said scalloped mounting tabs have two arcuate portions dimensioned and configured for engaging adjacent tubes in said spiral tube wall.

16. The apparatus as described in claim 7 wherein: said tube wall is a spiral tube wall and said means for mounting said U-shaped plate on said spiral tube wall includes a plurality of scalloped mounting tabs dimensioned and configured for engaging said spiral tube wall, said scalloped mounting tabs have two arcuate portions dimensioned and configured for engaging adjacent tubes in said spiral tube wall.

17. The apparatus as described in claim 8 wherein: said tube wall is a spiral tube wall and said means for mounting said U-shaped plate on said spiral tube wall includes a plurality of scalloped mounting tabs dimensioned and configured for engaging said spiral tube wall, said scalloped mounting tabs have two arcuate portions dimensioned and configured for engaging adjacent tubes in said spiral tube wall.

* * * * *